US007159649B2

(12) United States Patent
Thyrum et al.

(10) Patent No.: US 7,159,649 B2
(45) Date of Patent: Jan. 9, 2007

(54) AIR-TO-AIR HEAT EXCHANGER

(75) Inventors: Geoffrey P. Thyrum, Millersville, PA (US); Scott D. Garner, Lititz, PA (US)

(73) Assignee: Thermal Corp., Wilmington, DE (US)

( * ) Notice: Subject to any disclaimer, the term of this patent is extended or adjusted under 35 U.S.C. 154(b) by 285 days.

(21) Appl. No.: 10/893,767

(22) Filed: Jul. 16, 2004

(65) Prior Publication Data

US 2005/0199380 A1 Sep. 15, 2005

Related U.S. Application Data

(60) Provisional application No. 60/552,414, filed on Mar. 11, 2004.

(51) Int. Cl.
*F28F 3/00* (2006.01)

(52) U.S. Cl. ..... 165/165; 165/DIG. 399

(58) Field of Classification Search ..... 165/164–166, 165/DIG. 399
See application file for complete search history.

(56) References Cited

U.S. PATENT DOCUMENTS

| | | | | | |
|---|---|---|---|---|---|
| 3,331,435 | A | * | 7/1967 | Valyi | 165/166 |
| 3,404,446 | A | | 10/1968 | Kritzer | |
| 3,734,177 | A | * | 5/1973 | Bellovary et al. | 165/166 |
| 3,829,945 | A | * | 8/1974 | Kanzler et al. | 165/166 |
| 4,063,590 | A | * | 12/1977 | McConnell | 165/164 |
| 4,148,357 | A | * | 4/1979 | Forster et al. | 165/166 |
| 4,384,611 | A | * | 5/1983 | Fung | 165/166 |
| 4,460,388 | A | * | 7/1984 | Fukami et al. | 165/166 |
| 4,860,824 | A | * | 8/1989 | Foley et al. | 165/165 |
| 5,029,639 | A | * | 7/1991 | Finnemore et al. | 165/166 |
| 5,282,507 | A | * | 2/1994 | Tongu et al. | 165/165 |
| 5,350,012 | A | | 9/1994 | Sadowski et al. | |
| 5,584,341 | A | | 12/1996 | Sabin et al. | |
| 5,940,288 | A | | 8/1999 | Kociecki | |
| 6,059,023 | A | * | 5/2000 | Kurematsu | 165/165 |
| 6,408,941 | B1 | | 6/2002 | Zuo | |
| 6,920,920 | B1 | * | 7/2005 | Whittenberger | 165/165 |
| 2004/0031589 | A1 | * | 2/2004 | Lin | 165/80.3 |
| 2006/0048926 | A1 | * | 3/2006 | Richter | 165/165 |

FOREIGN PATENT DOCUMENTS

| | | | | |
|---|---|---|---|---|
| CA | 1026013 | | 2/1978 | |
| DE | 25 31 450 | | 1/1977 | |
| GB | 1 334 173 | | 10/1973 | |
| JP | 55118598 | A * | 9/1980 | 165/165 |
| JP | 57049793 | A * | 3/1982 | 165/166 |

OTHER PUBLICATIONS

IBM Technical Disclosure Bulletin; Biskeborn et al.; *Cooling fin Structure*; Jul. 1982; vol. 25, No. 2, pp. 618-619.

* cited by examiner

*Primary Examiner*—Leonard R. Leo
(74) *Attorney, Agent, or Firm*—Duane Morris LLP

(57) ABSTRACT

An air-to-air heat exchanger, is provided that comprises a folded fin core formed from a continuous sheet of thermally conductive material that has been folded into alternating flat ridges and troughs; an insert overlay having an opening including two sets of uniform fingers, wherein each finger has a portion protruding into and essentially filling each trough on one surface of the folded fin core; an inset region between each finger portion and the end edges of each trough; a sealant within each inset region sealably attaching the insert overlay to the folded fin core; and an air flow divider plate. Heat exchanger components are also provided.

16 Claims, 14 Drawing Sheets

AIR-TO-AIR HEAT EXCHANGER

CROSS-REFERENCE TO RELATED PATENT APPLICATIONS

This application is related to and claims priority from U.S. Provisional Patent Application No. 60/552,414, filed on Mar. 11, 2004.

FIELD OF THE INVENTION

The present invention generally relates to heat-exchangers, and more particularly to heat-exchangers of the type including plates arranged side-by-side and mutually parallel.

BACKGROUND OF THE INVENTION

Heat-exchangers having a plurality of mutually parallel plates, with channels that are adapted to carry at least one heat transfer fluid, are well known in the art. Such parallel plate devices are often formed by folding a continuous sheet of metal to yield a so called "folded-fin" heat exchanger. The plates in such prior art heat-exchangers sometimes form a circuit path for circulation of two independent fluids, in counterflow, from one end of the heat-exchanger to the other. The plates are often connected to one another at their longitudinal edges by longitudinal braces or the like that are fixed together by a leak-tight wall extending over the entire length and height of the bundle of plates. The plates define a central zone for heat exchange between the fluids.

In some prior art heat exchange structures, the plates may have one or more corrugated sheets positioned between them, along the entire central heat transfer and exchange zone, to enhance heat exchange with the plates by increasing surface area and introducing turbulence in the flowing liquids. For example, U.S. Pat. No. 5,584,341, discloses a plate bundle for a heat-exchanger including a stack of mutually parallel metal heat-exchange plates. Each heat-exchange plate includes smooth-surfaced edges and a corrugated central portion which, with the associated heat-exchange plates, forms a double circuit for circulation of two independent fluids in counterflow. The plates are connected to one another at their longitudinal edges by connection structures, and have a zone of heat transfer and exchange between the fluids. Another zone is formed at the free ends of the plates for inlet and outlet of the fluids. The fluid inlet and outlet zones are formed by the plane ends of the heat-exchange plates.

A significant disadvantage in prior art heat-exchangers of this type is the inherent thermal impedance, i.e., resistance to thermal conduction through the thickness of the plate, associated with the materials used to form the heat-exchange plates. These prior art heat-exchange plates must have sufficient thickness so as to provide the requisite structural integrity needed for the physical demands that are placed upon such devices in normal use. Very often, the heat exchange plates are required to structurally support a portion of the heat exchanger. These design requirements typically require a minimum material thickness (e.g., a material thickness that is some minimum percentage of the plate's width or length) that results in a disadvantageously large inherent thermal impedance. Material selection is also dictated by this requirement, normally resulting in only metals being selected for the heat-exchange plates. Polymer materials typically exhibit significant dielectric and thermal insulating properties that preclude their use in heat-exchange plates, especially when they are required to provide structural integrity to the device.

U.S. Pat. No. 6,408,941, discloses a folded fin heat-exchanger that provides for the use of very thin materials and even polymeric materials such as one or more of the well known engineering polymers, e.g., polyhalo-olefins, polyamides, polyolefins, poly-styrenes, polyvinyls, polyacrylates, polymethacrylates, polypropylene, polyesters, polystyrenes, polydienes, polyoxides, polyamides and polysulfides and their blends, co-polymers and substituted derivatives thereof, in its fabrication. However, there continues to be a need for enhanced air-to-air heat exchangers that are low cost and simple to manufacture.

SUMMARY OF THE INVENTION

The present invention provides an air-to-air heat exchanger having a folded fin core that includes a plurality of substantially parallel, thin fin walls that are spaced apart from one another by alternating ridges and troughs so as to define a top face and a bottom face. A frame is positioned in overlying relation to the folded fin core. The frame includes a pair of spaced-apart confronting lateral rails and a pair of spaced apart longitudinal rails that together define the central opening. A plurality of fingers project inwardly and downwardly from an interior side of each of the lateral rails so that one of the plurality of fingers is sealingly received within each trough of the folded fin core. The air-to-air heat exchanger also includes an air flow divider plate positioned in overlying relation to the top face and between the lateral rails.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts and further wherein.

DETAILED DESCRIPTION OF THE PREFERRED EMBODIMENTS

Figure 1:
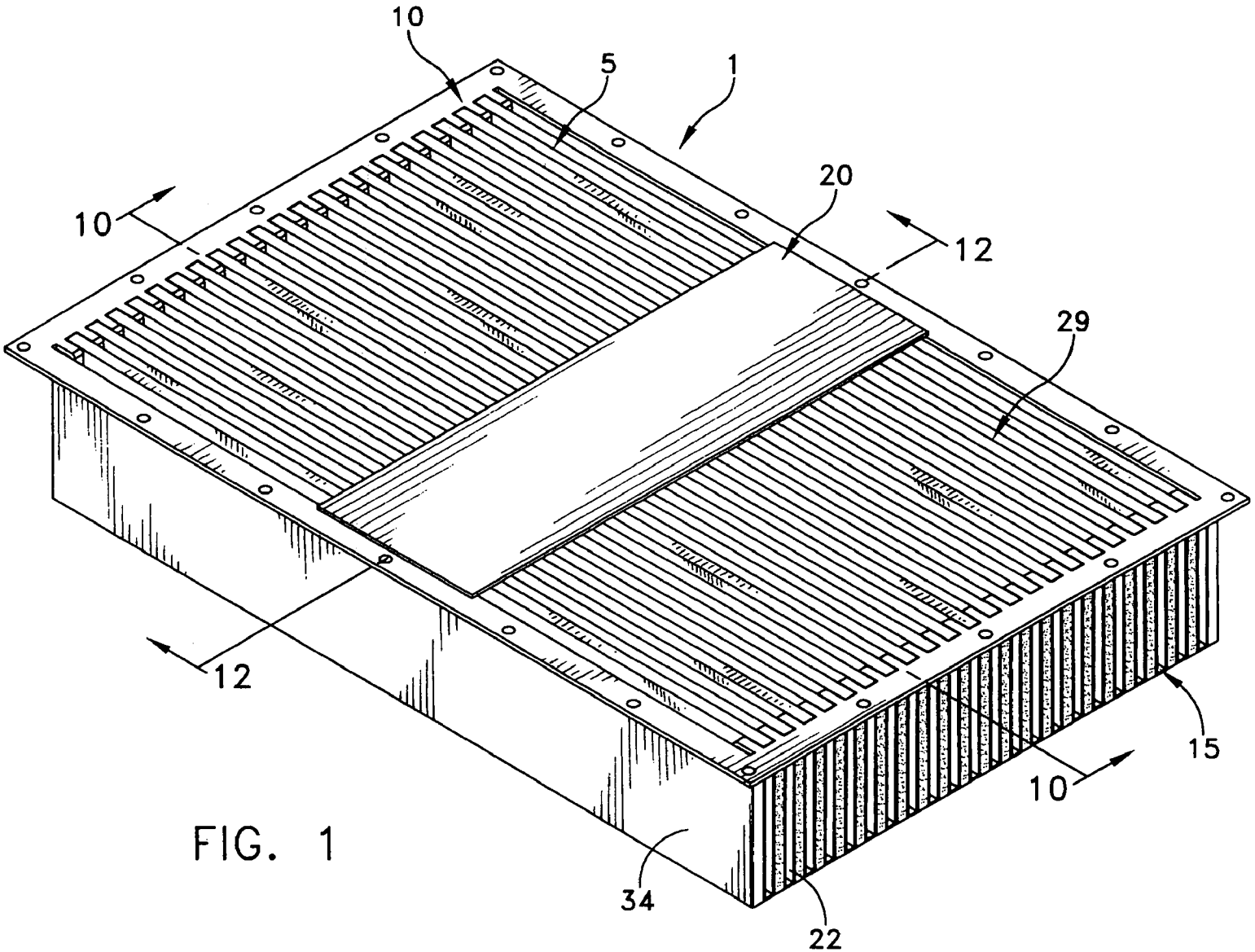
FIG. 1 is a perspective view of an air-to-air heat exchanger formed in accordance with the present invention showing a folded fin core, an insert overlay, a sealed inset region, and an air flow divider plate.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. In the claims, means-plus-function clauses are intended to cover the structures described, suggested, or rendered obvious by the written description or drawings for performing the recited function, including not only structural equivalents but also equivalent structures.

Referring to FIGS. 1–4, an air-to-air heat exchanger 1 formed in accordance with the present invention includes a folded fin core 5, an insert overlay 10, sealed inset regions 15, and an air flow divider plate 20. Folded fin core 5 includes a plurality of substantially parallel, thin fin walls 22 that are spaced apart from one another by alternating flat ridges 25 and troughs 27, a top face 29 and a bottom face 31. Each pair of thin fin walls 22 are spaced apart by flat ridge 25 so as to form each trough 27. Folded fin core 5 also includes end fin walls 34. Folded fin core 5 may be formed by folding a continuous sheet of thermally conductive material, such as a metal or a polymer, back-and-forth upon itself so as to create a pleated or corrugated cross-sectional profile. Folded fin core 5 may be formed from any of the metals known for having superior heat transfer and structural properties, such as stainless steel, aluminum and its alloys, copper and its alloys, as well as other thermally conductive metals and combinations of metals. Alternatively, folded fin core 5 may be formed from a polymer, such as one or more of the well known engineering polymers, e.g., polyhalo-olefins, polyamides, polyolefins, poly-styrenes, polyvinyls, poly-acrylates, polymethacrylates, polypropylene, polyesters, polystyrenes, polydienes, polyoxides, polyamides and polysulfides and their blends, copolymers and substituted derivatives thereof.

Figure 5:
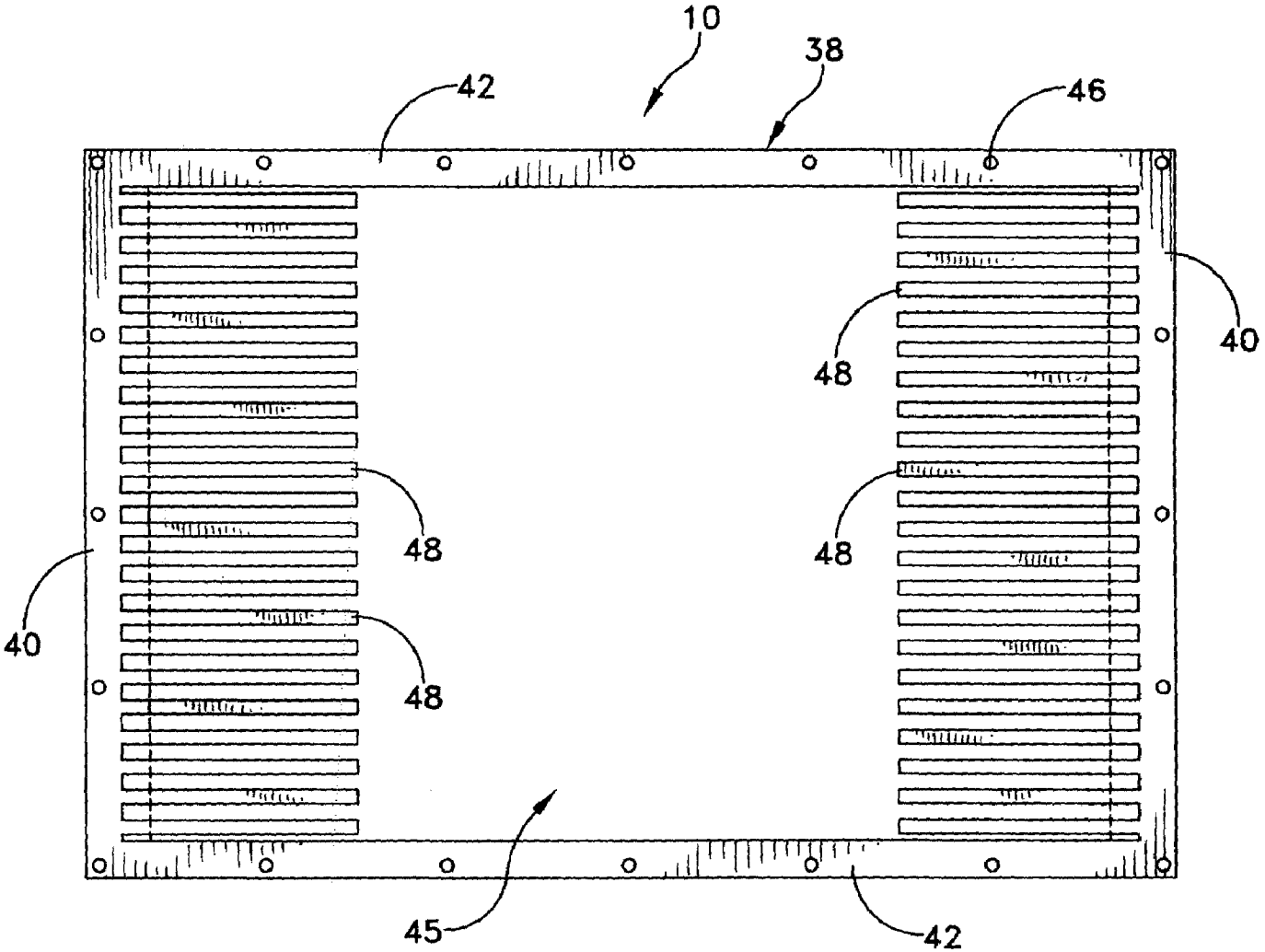
FIG. 5 is a top plan view of a flat sheet precursor of an inset overlay.
Figure 6:
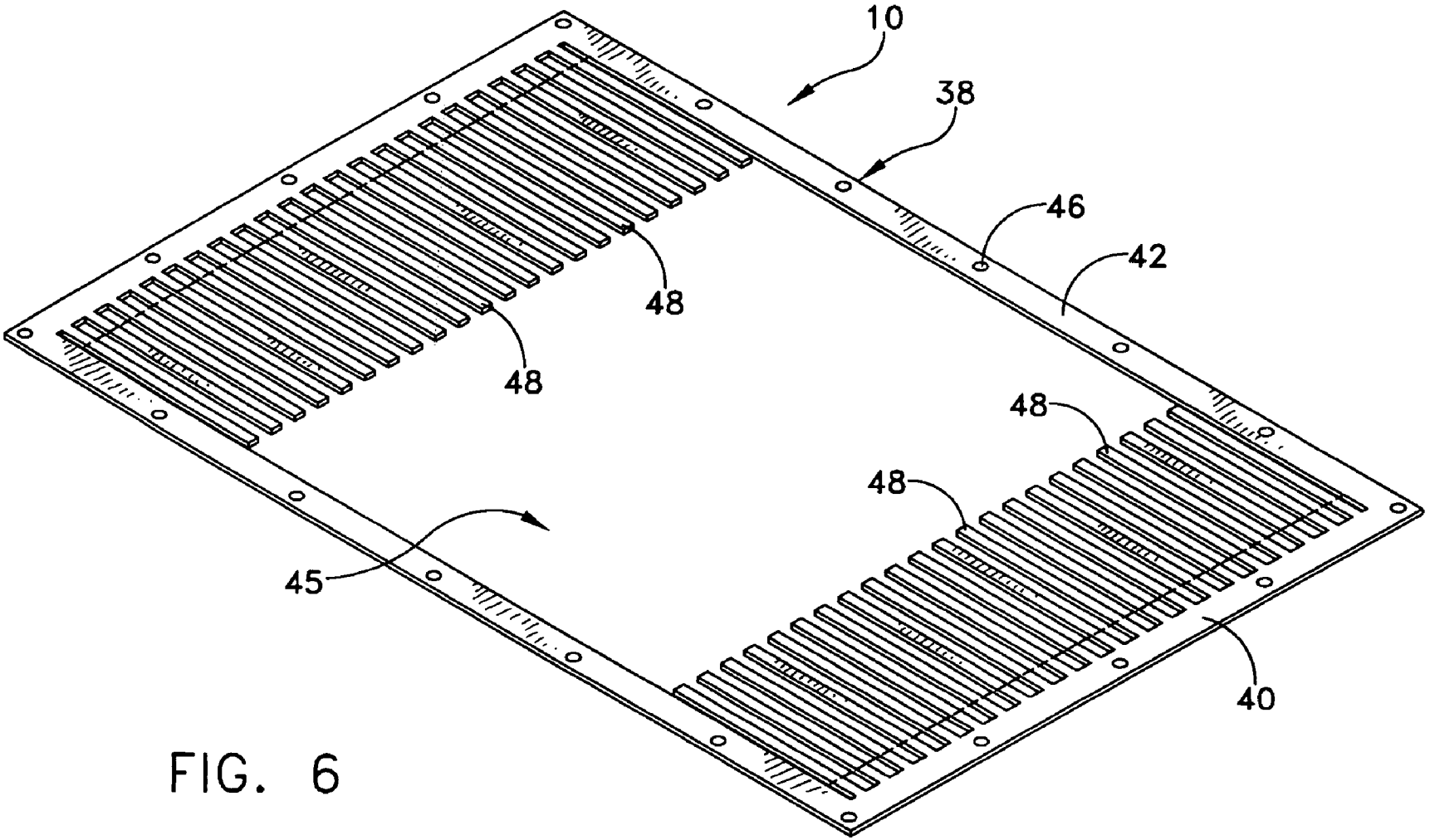
FIG. 6 is a perspective view of the flat sheet precursor shown in FIG. 5.
Figure 7:
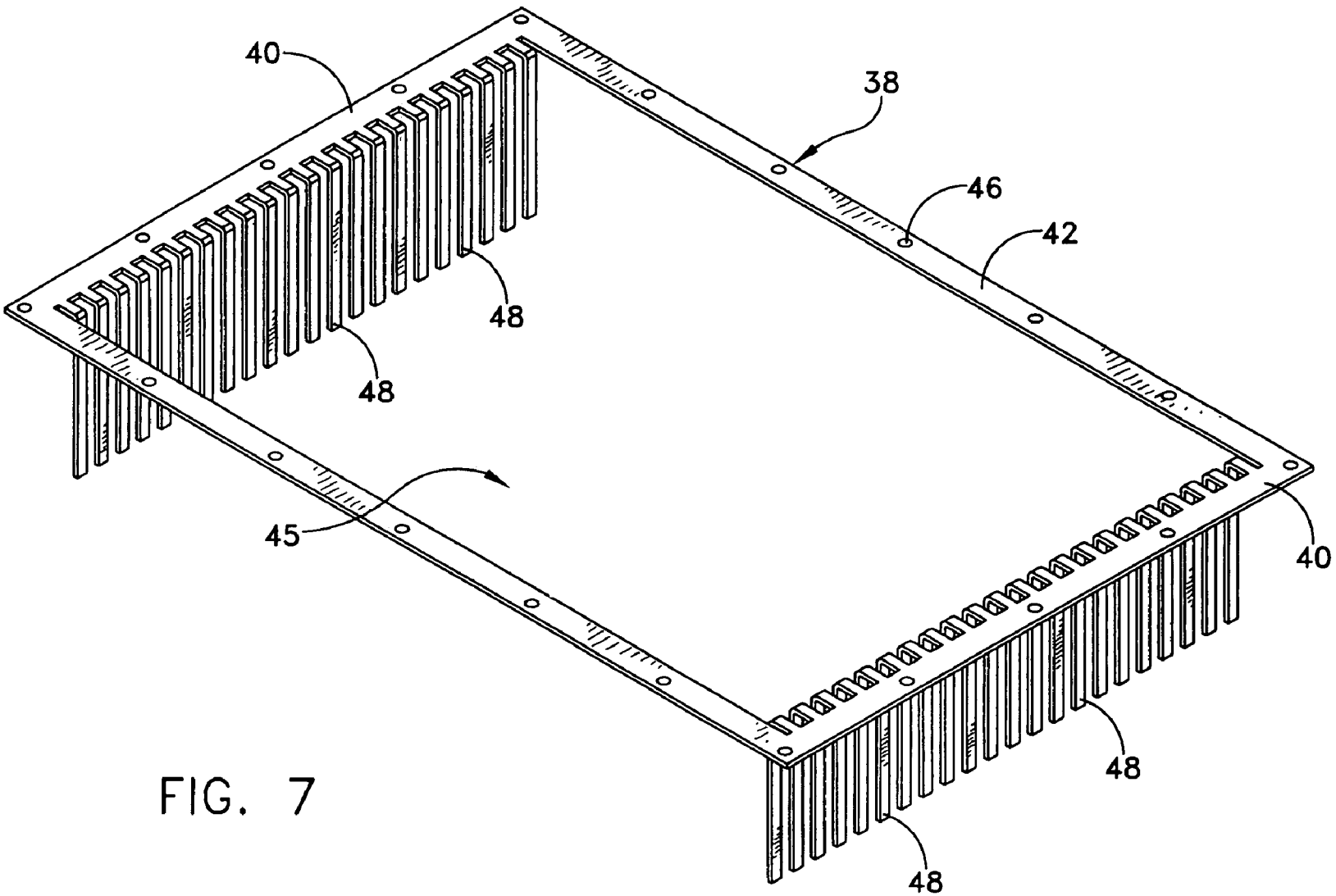
FIG. 7 is a perspective view of an insert overlay produced from the flat sheet precursor shown in FIGS. 5 and 6.
Figures 8, 9:
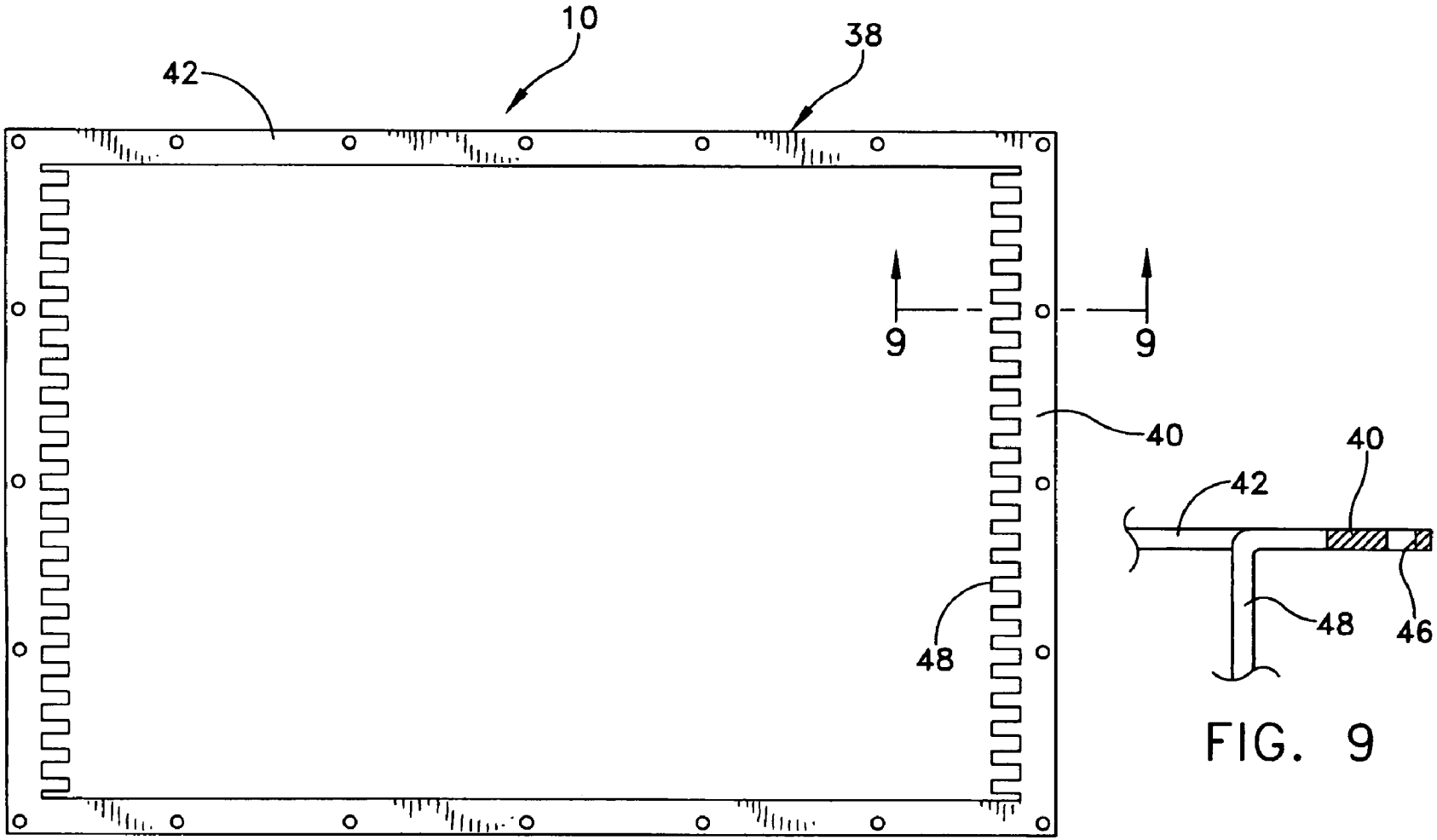
FIG. 8 is a top plan view of the insert overlay shown in FIG. 7.
FIG. 9 is an enlarged, partially cross-sectional view of bent and unbent finger portions of the insert overlay shown in FIG. 7.
Figure 10:
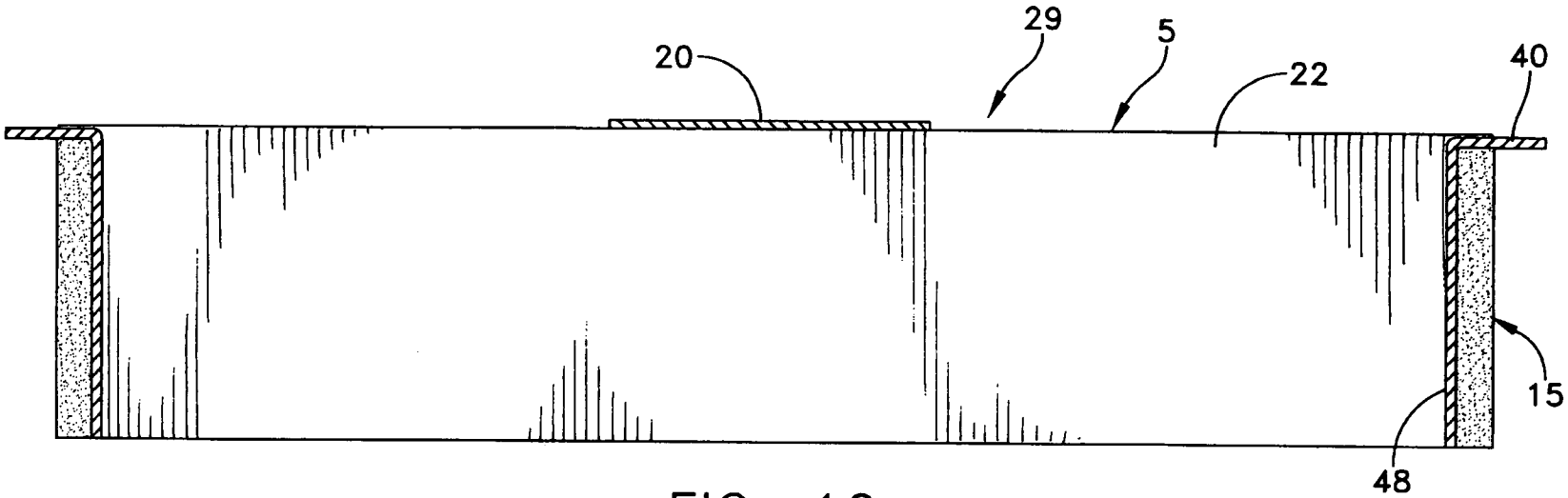
FIG. 10 is a cross-sectional view of an assembled air-to-air heat exchanger, as taken along line 10—10 in FIG. 1.
Figure 11:
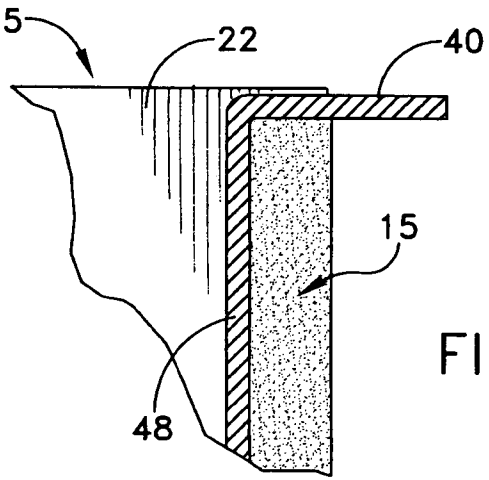
FIG. 11 is a broken-away, cross-sectional view of the inset shown in FIG. 10.
Figure 12:
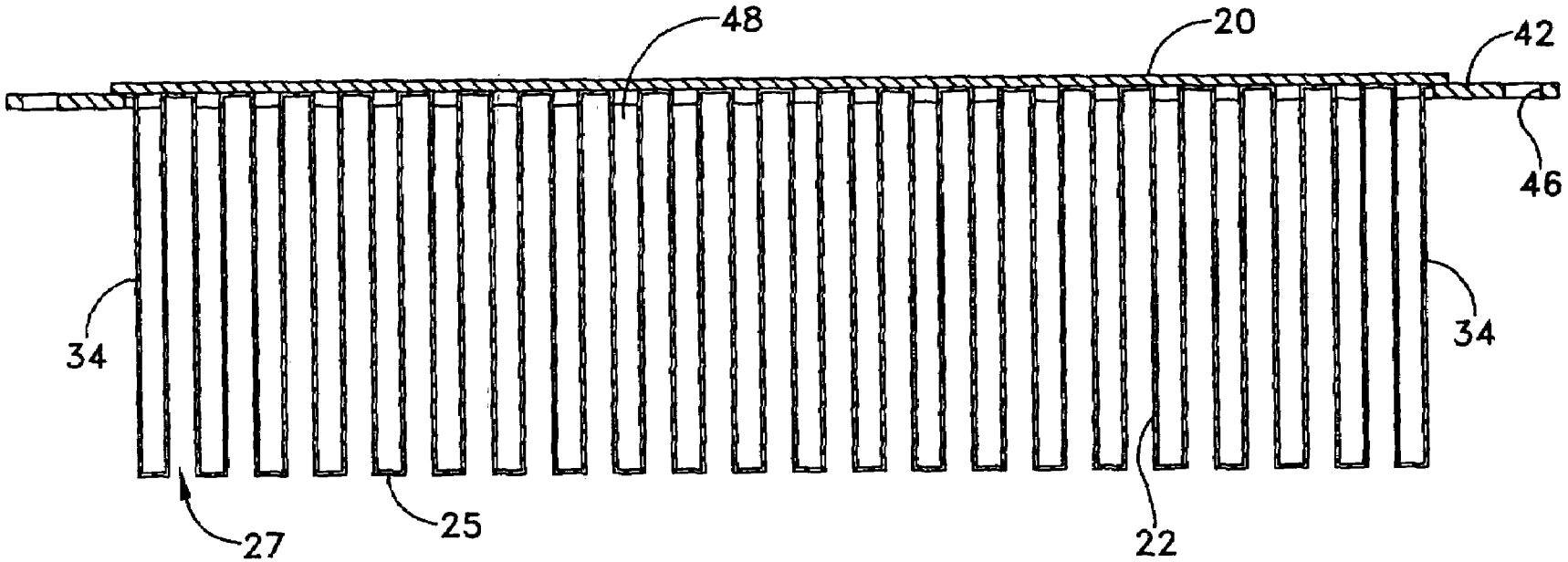
FIG. 12 is a cross-sectional view of the final assembled heat exchanger, as taken along line 12—12 in FIG. 1.

Referring to FIGS. 2 and 5–11, insert overlay 10 includes a frame 38 formed from a pair of spaced-apart lateral rails 40 and a pair of spaced apart longitudinal rails 42 that together define a central opening 45. In a preferred embodiment of the invention, insert overlay 10 has a generally rectangular shape, with rails 40 and 42 including mounting holes 46. A plurality of spaced apart, parallel fingers 48 project inwardly from an interior side of each lateral rail 40 toward the opposing lateral rail 40 (FIGS. 5 and 6). Prior to assembly to folded fin core 5, fingers 48 are bent downwardly relative to frame 38 by approximately 90° (FIG. 7). Adjacent fingers, among plurality of fingers 48, are arranged and spaced apart so as to be complementary to corresponding troughs 27 in folded fin core 5.

Referring to FIGS. 1,2,10–12, air flow divider plate 20 is formed from a substantially flat sheet of metal or polymer that is sized and shaped to correspond to at least a portion of top face 29 of folded fin core 5 that is bounded by frame 38.

Figure 2:
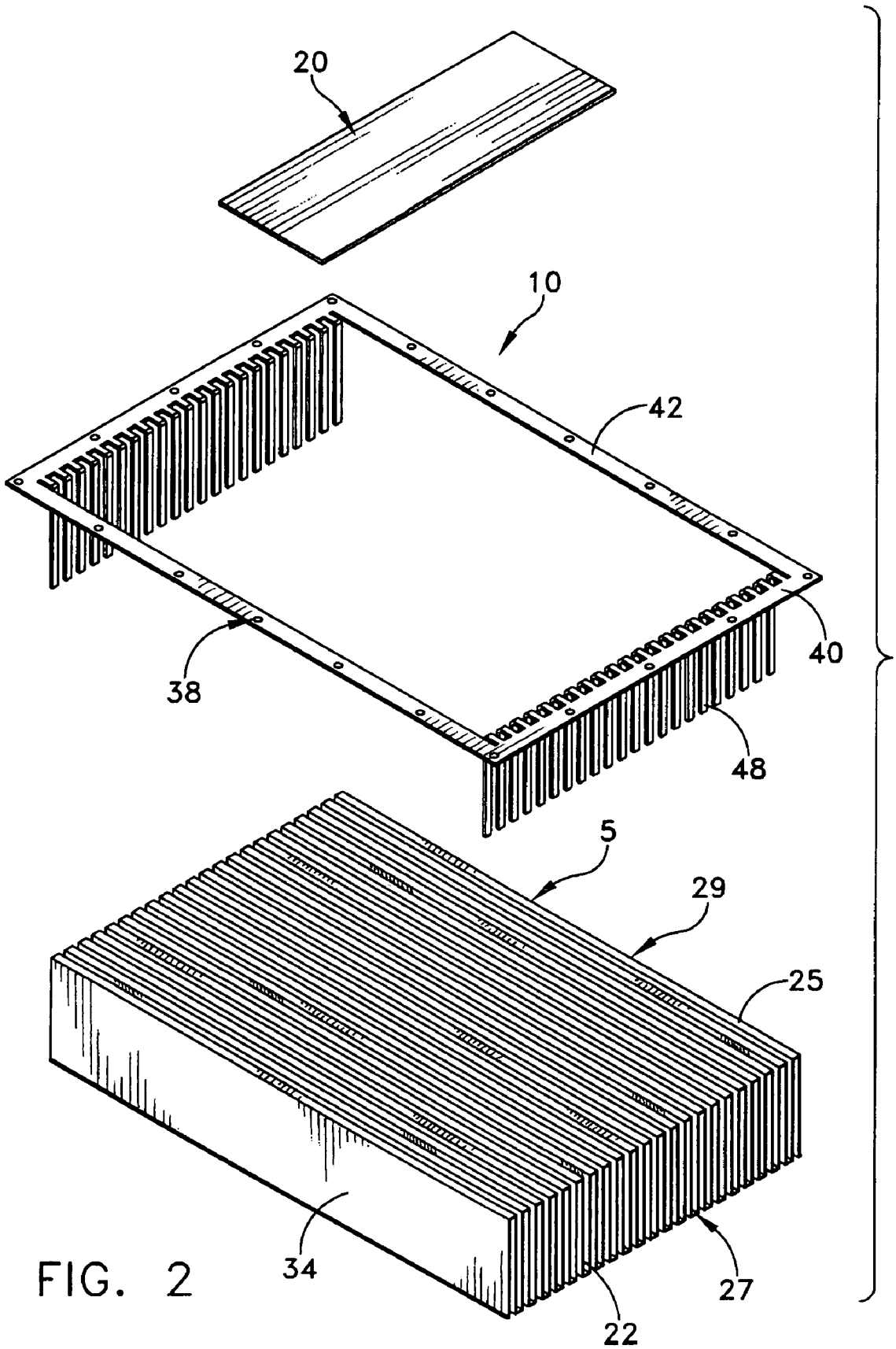
FIG. 2 is an exploded perspective view of the air-to-air heat exchanger shown in FIG. 1.
Figure 3:
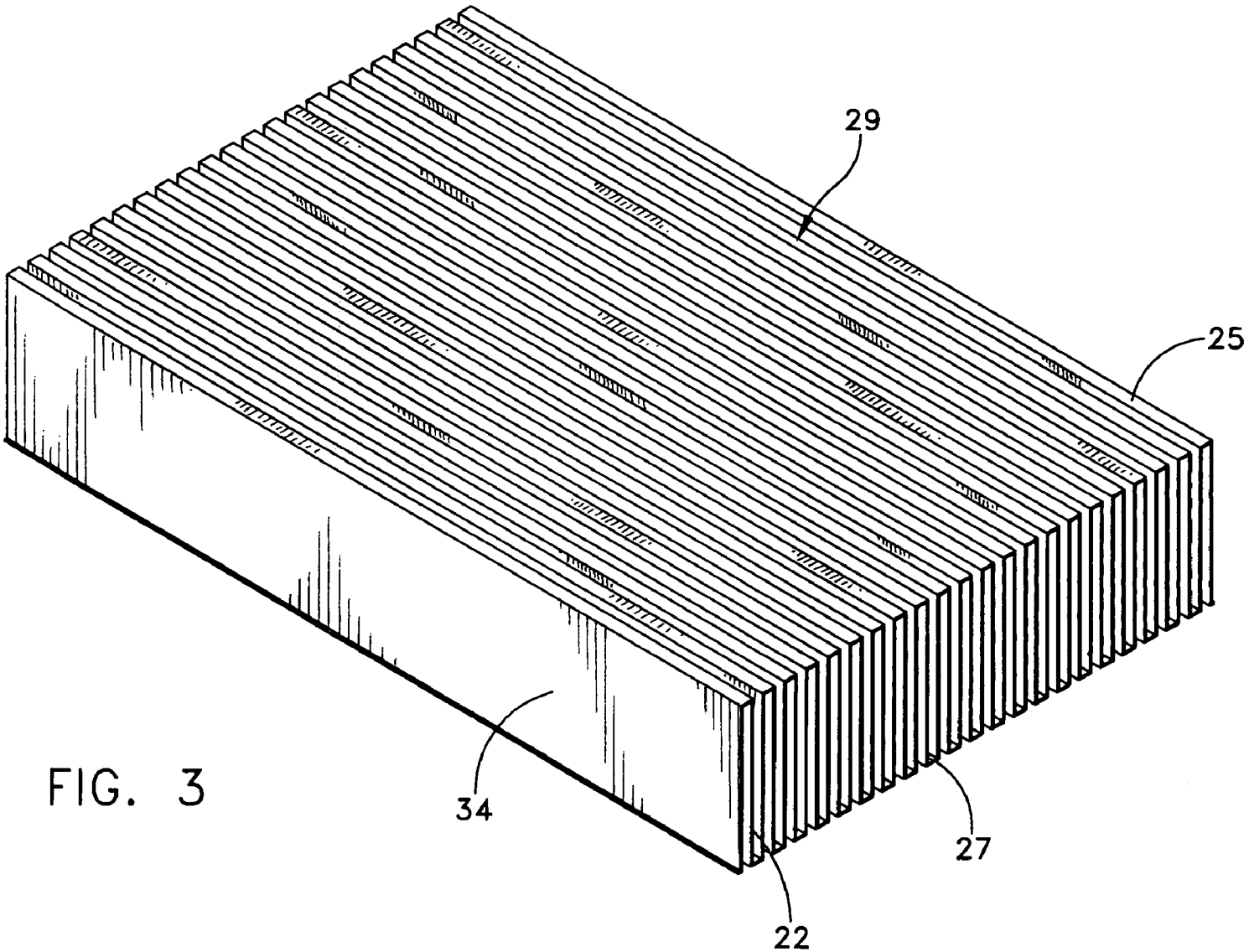
FIG. 3 is a perspective view of a folded fin core.
Figure 4:
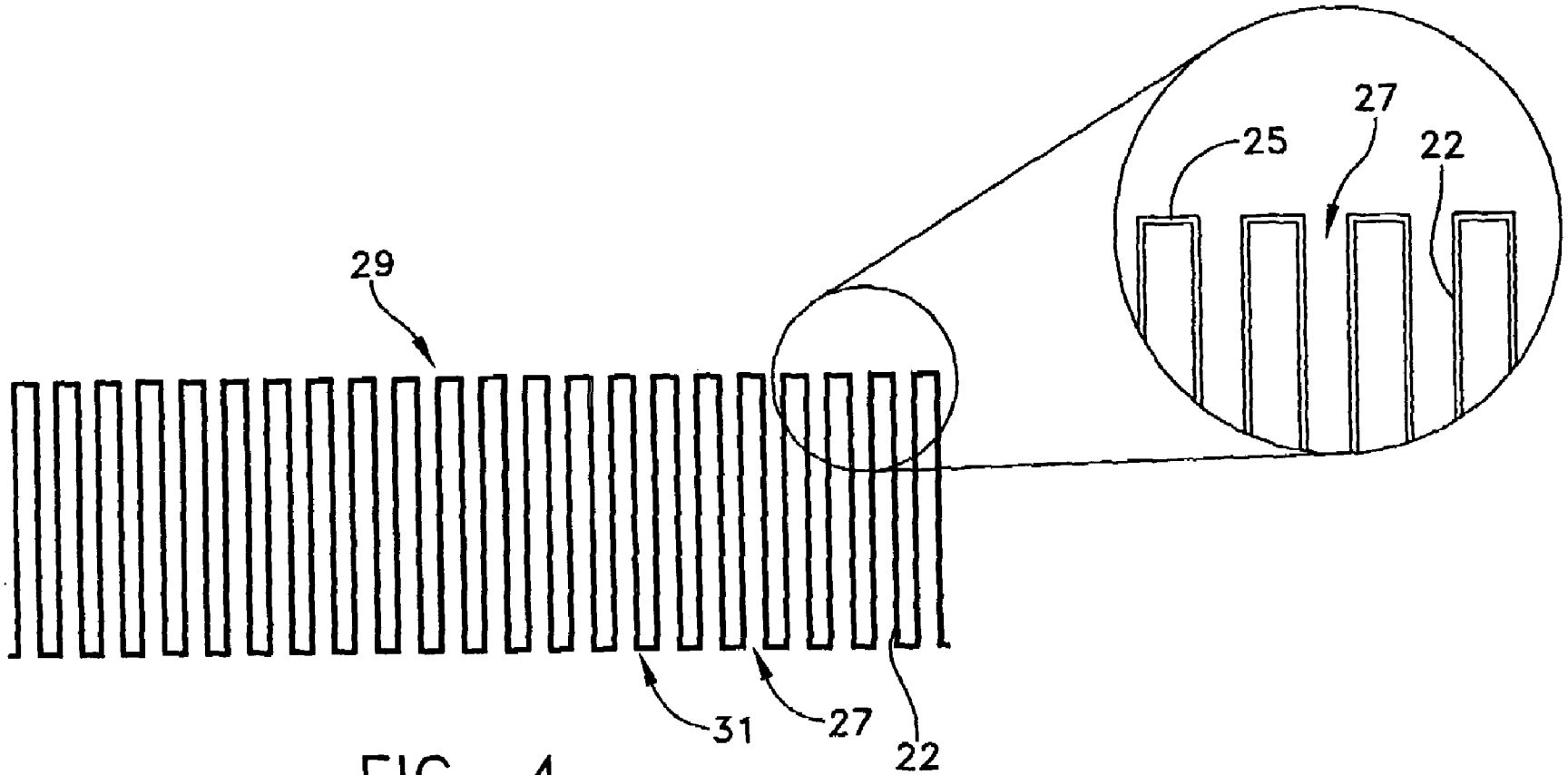
FIG. 4 is an end view a folded fin core.

Referring to FIG. 2, air-to-air heat exchanger 1 is assembled in the following manner. Folded fin core 5 is positioned below insert overlay 10 so that longitudinal rails 42 are in substantially parallel spaced relation with flat ridges 25. In this position, fingers 48 are arranged in spaced confronting relation to corresponding troughs 27 of folded fin core 5. Once in this position, insert overlay 10 is moved toward folded fin core 5 so that each individual finger 48 is received within an individual trough 27 of folded fin core 5. Insert overlay 10 continues to move toward folded fin core 5 until the tips of fingers 48 engage the interior surfaces of flat ridges 25 at the bottom of their respective troughs 27. A suitable sealant material, e.g., silicone rubber or the like, is applied between fingers 48 and each thin fin wall 22 that forms its respective trough 27. In this position, lateral rails 40 of frame 38 extend beyond the free end edge of folded fin core 5, with longitudinal rails 42 positioned in parallel relation to flat ridges 25 and troughs 27, and above end fin walls 34. Once insert overlay 10 has been affixed to folded fin core 5, air flow divider plate 20 is positioned between longitudinal rails 42 of frame 38, so as to be in spaced parallel relation to lateral rails 40 of frame 38 and overlying top face 29 of folded fin core 5. Air flow divider plate 20 is then fastened to frame 38 and folded fin core 5 by conventional fastening techniques known in the art, e.g., welding, brazing, adhesives, or the like.

Figure 13:
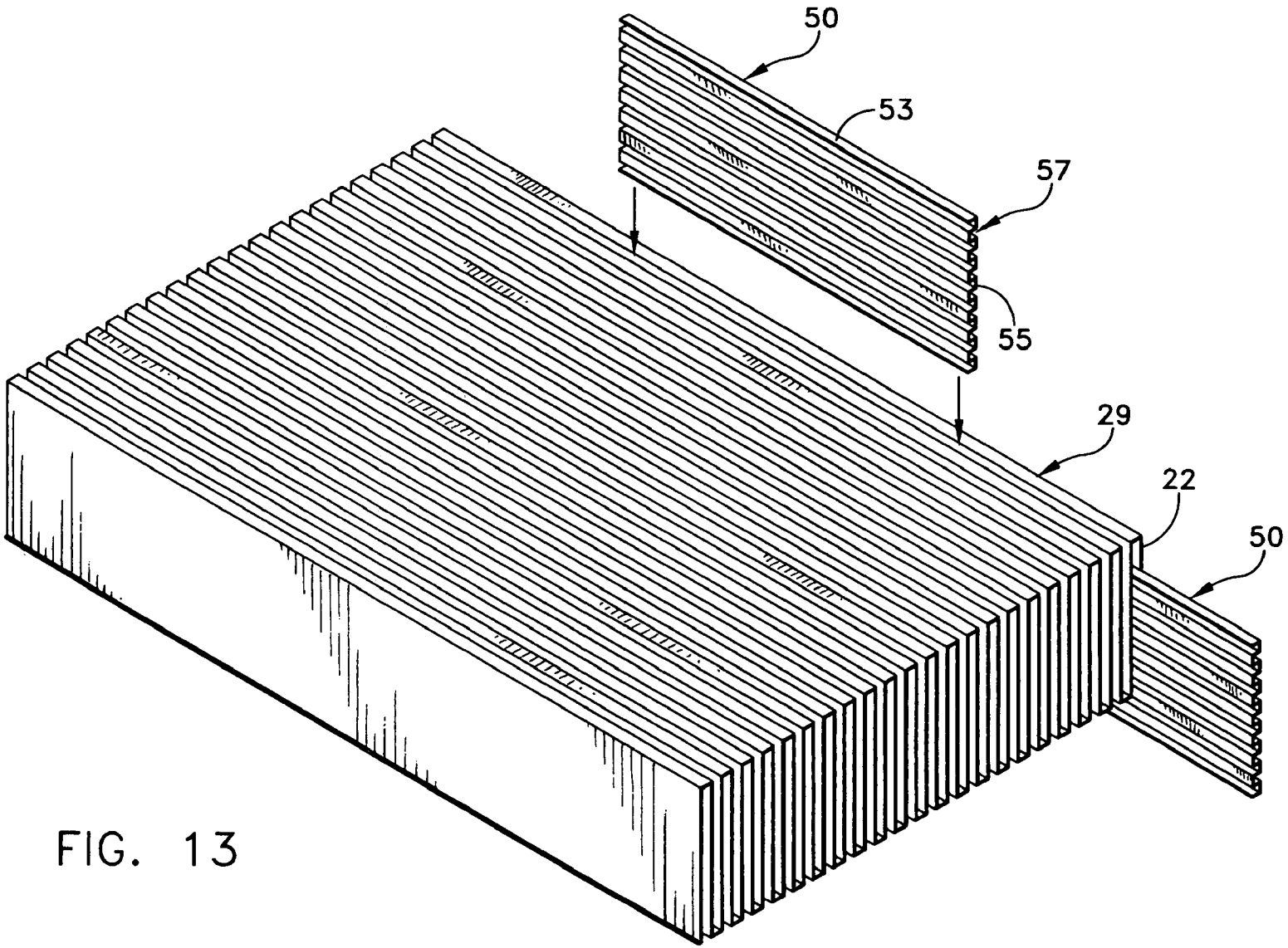
FIG. 13 is a partially exploded, perspective view of one alternative embodiment of the air-to-air heat exchanger invention including folded fin inserts.
Figure 14:
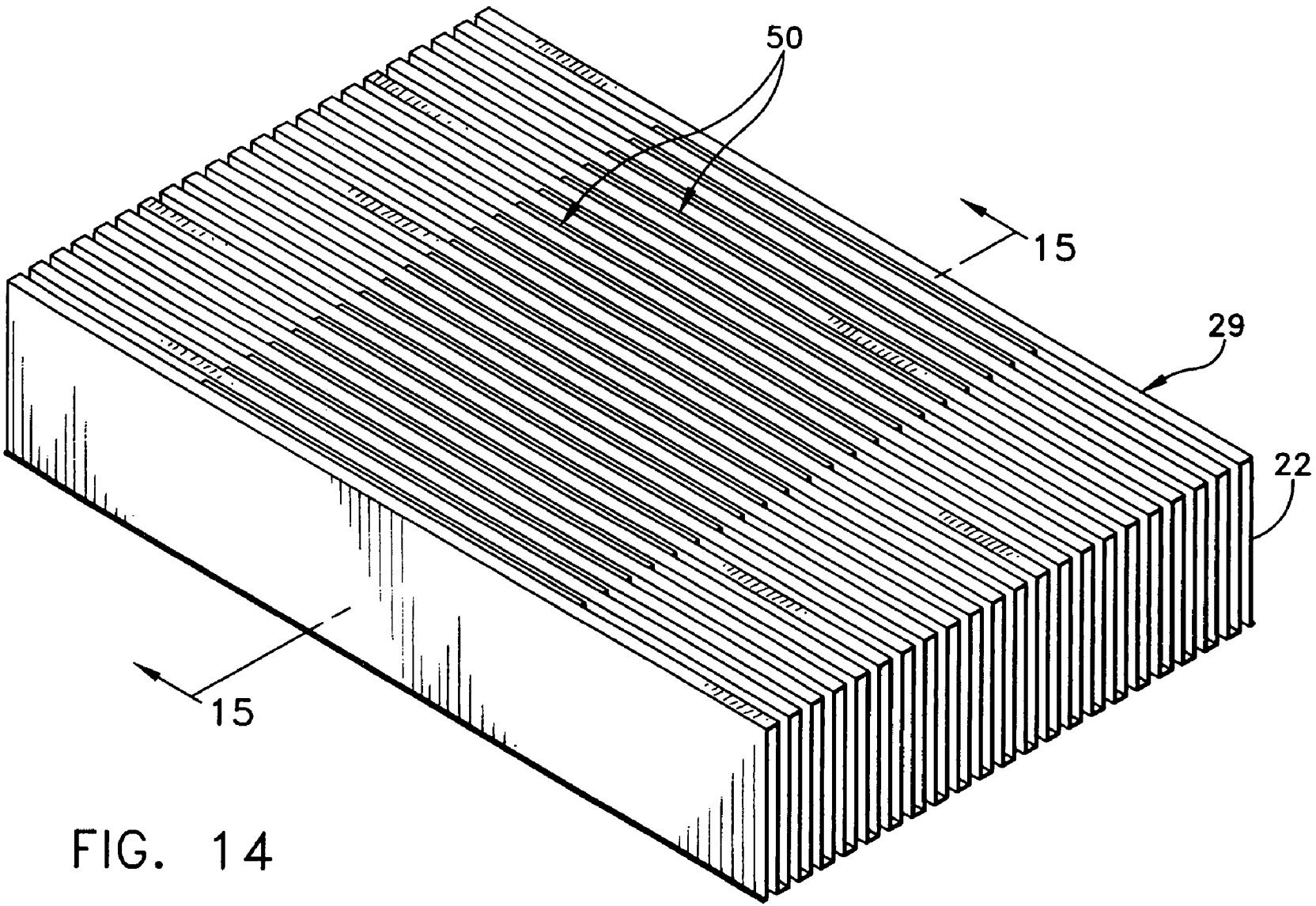
FIG. 14 is a perspective view of the air-to-air heat exchanger shown in FIG. 13, with the folded fin inserts fully assembled.
Figure 16:
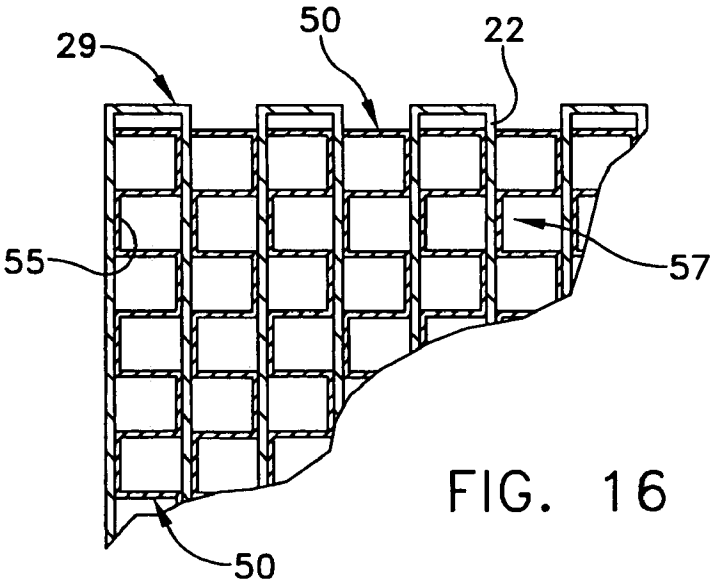
FIG. 16 is a broken-away, enlarged view of a portion of the air-to-air heat exchanger shown in FIG. 15.
Figure 15:
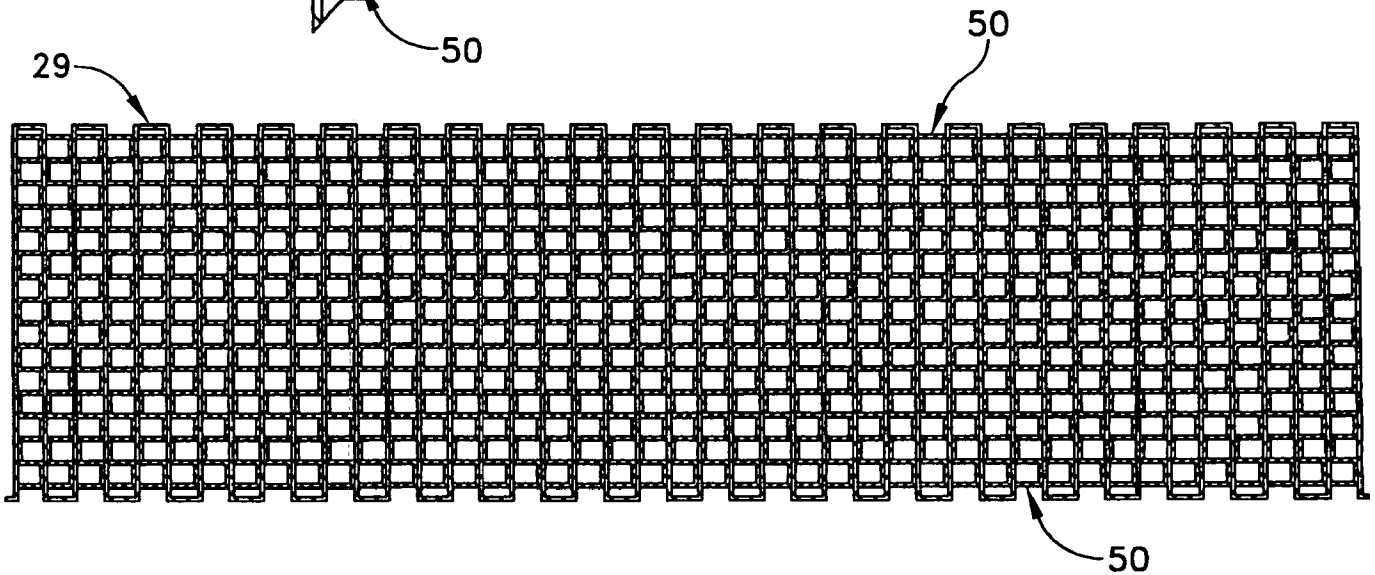
FIG. 15 is a side plan view of the air-to-air heat exchanger shown in FIG. 14.
Figure 19:
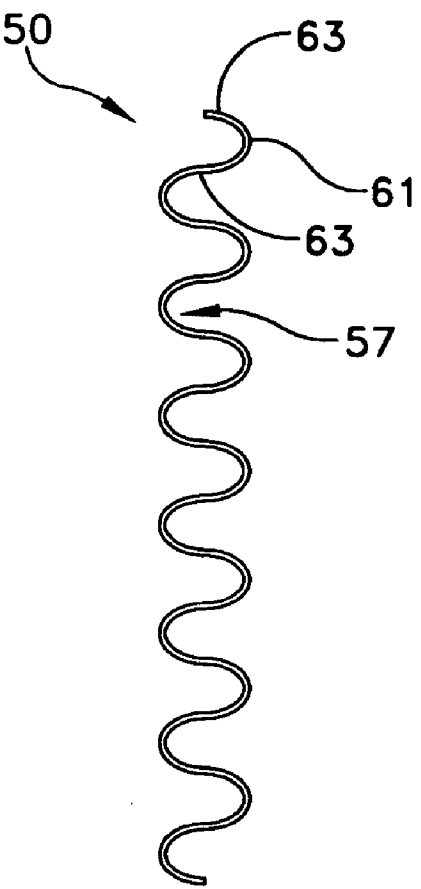
FIGS. 17–19 comprise end-on views of a variety of folded fin inserts that may be used in connection with the air-to-air heat exchanger shown in FIGS. 13–16.
Figure 18:
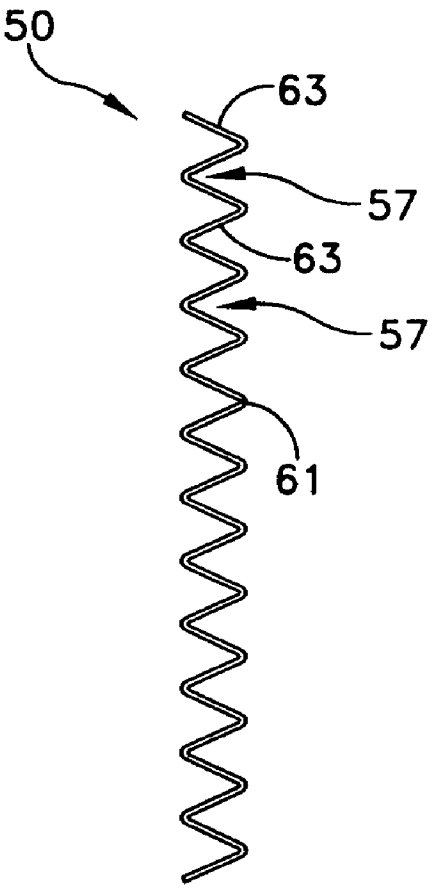
Figure 17:
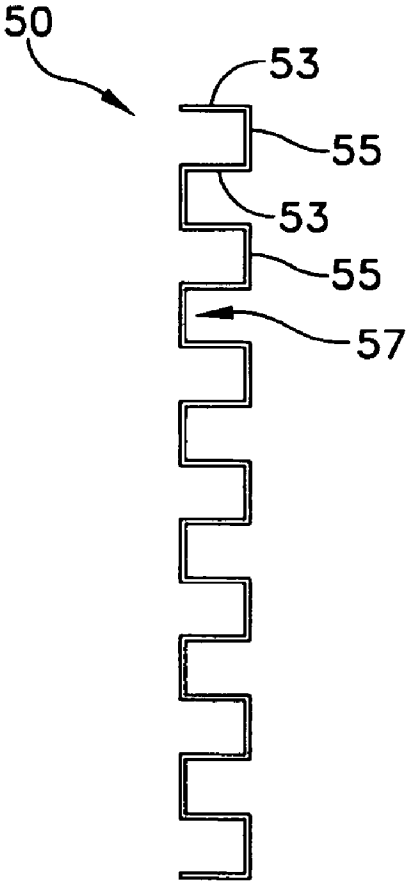

In operation, air-to-air heat exchanger 1 is positioned so that air flow is created on one side of air flow divider plate 20. Heat laden air passes through troughs 27 thereby exchanging heat through conduction with thin fin walls 22. The flowing air exits air-to-air heat exchanger 1 from adjacent the air flow divider plate 20. The conductive exchange of heat within air-to-air heat exchanger 1 may be enhanced by introducing fin inserts 50 (FIGS. 13–17). More particularly, additional thermal conduction surfaces are provided between adjacent thin fin walls 22 by introducing fin inserts 50 (FIGS. 13 and 14). Each fin insert 50 includes a plurality of substantially parallel insert walls 53 that are separated from one another by alternating flat ridges 55 and troughs 57. Each pair of insert walls 53 are spaced-apart by a flat ridge 55 so as to form each trough 57 between them. Thus, each fin insert 50 comprises a continuous sheet of thermally conductive material folded into alternating flat ridges 55 and troughs 57 defining spaced insert walls 53. Each flat ridge 55 provides a flat top surface that is more suitable for brazing, soldering, or welding, or otherwise thermally attaching flat ridge 55 to confronting surfaces of thin fin walls 22 (FIGS. 15–16). Advantageously, the introduction of fin inserts 50 into air-to-air heat exchanger 1 acts to reduce the pneumatic cross-section thereby increasing the pneumatic pressure exerted by a coolant fluid against thin fin walls 22. This arrangement helps to increase conductive heat transfer from air-to-air heat exchanger 1 to the flowing coolant fluid, e.g., air. Of course, pointed or rounded ridges 61 (FIGS. 17–19) may also be incorporated into fin insert 50.

It is to be understood that the present invention is by no means limited only to the particular constructions herein disclosed and shown in the drawings, but also comprises any modifications or equivalents within the scope of the claims.

What is claimed is:

1. An air-to-air heat exchanger comprising:

a folded fin core including a plurality of troughs and ridges;

a frame having peripheral rails that together define a central opening and a plurality of fingers extending into said central opening from confronting portions of said peripheral rails, wherein each of said plurality of fingers is bent about ninety degrees relative to said frame so that a portion of each finger projects outwardly from said central opening so that when said frame is positioned in overlying relation to said folded fin core one of said plurality of fingers is sealingly received within each trough of said folded fin core; and an air flow divider plate positioned in overlying relation to said folded fin core and between said confronting portions of said peripheral rails.

2. An air-to-air heat exchanger according to claim 1 wherein said folded fin core includes a plurality of substantially parallel, thin fin walls that are spaced apart from one another by alternating flat ridges and troughs so as to define a top face and a bottom face.

3. An air-to-air heat exchanger according to claim 1 wherein said folded fin core is formed from a material selected from the group consisting of stainless steel, aluminum and its alloys, copper and its alloys.

4. An air-to-air heat exchanger according to claim 1 wherein said folded fin core is formed from a material selected from the group consisting of polyhalo-olefins, polyamides, polyolefins, poly-styrenes, polyvinyls, polyacrylates, polymethacrylates, polypropylene, polyesters, polystyrenes, polydienes, polyoxides, polyamides and polysulfides and their blends, co-polymers and substituted derivatives thereof.

5. An air-to-air heat exchanger according to claim 1 wherein said frame includes a pair of spaced-apart confronting lateral rails and a pair of spaced apart longitudinal rails that together define said central opening.

6. An air-to-air heat exchanger according to claim 5 wherein said frame comprises rectangular shape.

7. An air-to-air heat exchanger according to claim 5 wherein said plurality fingers are arranged on said lateral rails in spaced apart parallel relation to one another wherein each of said plurality of fingers comprises a first portion that projects into said central opening in substantially coplanar relation to said lateral rails and a second portion that projects outwardly from said first portion relative.

8. An air-to-air heat exchanger according to claim 7 wherein said plurality of fingers project inwardly along a first portion of their length, and downwardly along a second portion of their length from an interior side of each of said lateral rail.

9. An air-to-air heat exchanger according to claim 7 wherein adjacent fingers among said plurality of fingers are arranged and spaced apart so as to be complementary to corresponding troughs.

10. An air-to-air heat exchanger according to claim 7 wherein said folded fin core includes a plurality of substantially parallel, thin fin walls that are spaced apart from one another by alternating flat ridges and troughs so as to define a top face and a bottom face and spaced apart free end edges such that said folded fin core is positioned below said frame so that said longitudinal rails and said first portions are in substantially parallel spaced relation to said flat ridges.

11. An air-to-air heat exchanger according to claim 10 wherein each of said plurality of fingers comprises a tip that engages an interior surface of a flat ridge and is sealingly fastened inwardly of a free end edge.

12. An air-to-air heat exchanger according to claim 10 wherein said lateral rails extend beyond the free end edges of said folded fin core, with said air flow divider plate positioned between said longitudinal rails so as to be in spaced parallel relation to said lateral rails and in overlying relation to a top face of said folded fin core.

13. An air-to-air heat exchanger according to claim 1 wherein said plurality of fingers are bent downwardly relative to said frame by no more than 90°.

14. An air-to-air heat exchanger according to claim 1 wherein said air flow divider plate is fixedly fastened to said folded fin core.

15. An air-to-air heat exchanger comprising:

a folded fin core including a plurality of substantially parallel, thin fin walls that are spaced apart from one another by alternating ridges and troughs so as to define a top face and a bottom face;

a frame having a pair of spaced-apart confronting lateral rails and a pair of spaced apart longitudinal rails that together define an inner central opening;

a plurality of fingers each projecting inwardly and downwardly from an interior side of each of said lateral rails such that a first portion that projects into said inner central opening in substantially coplanar relation to said lateral rails and a second portion projects outwardly from said first portion, wherein said frame is positioned in overlying relation to said folded fin core so that one of said plurality of fingers is sealingly received within each trough of said folded fin core; and an air flow divider plate positioned in overlying relation to said top face and between said lateral rails.

16. An air-to-air heat exchanger comprising:

a folded fin core including a plurality of fin walls defining troughs and ridges therebetween and spaced apart free end edges;

a folded fin insert positioned between said fin walls;

a frame having peripheral rails that together define a central opening and a plurality of fingers extending from confronting portions of said peripheral rails such that a first portion that projects into said central opening in substantially coplanar relation to said frame and a second portion projects outwardly from said first portion, wherein said frame is positioned in overlying relation to said folded fin core so that one of said plurality of fingers is sealingly received within each trough of said folded fin core inwardly of a free end edge; and an air flow divider plate positioned in overlying relation to said folded fin core and between said confronting portions of said peripheral rails.

* * * * *